United States Patent [19]

Zicko

[11] 4,373,687

[45] Feb. 15, 1983

[54] DISPENSING CONTAINER

[75] Inventor: James A. Zicko, Natick, Mass.

[73] Assignee: Container Corporation of America, Chicago, Ill.

[21] Appl. No.: 250,084

[22] Filed: Apr. 1, 1981

[51] Int. Cl.[3] ..... B65H 55/00; B65H 57/12

[52] U.S. Cl. ..... 242/163; 206/409; 206/395

[58] Field of Search ..... 206/408, 409, 395, 396, 206/389; 229/17 R, 7 R, 45; 242/163, 146; 221/208, 257; 239/136

[56] References Cited

U.S. PATENT DOCUMENTS

| | | | |
|---|---|---|---|
| 963,114 | 7/1910 | Berry | 242/163 |
| 1,431,352 | 10/1922 | Abbott | 242/146 |
| 1,640,368 | 8/1927 | Obetz et al. | 206/409 |
| 1,869,927 | 8/1932 | Wurzburg | 229/45 |
| 2,020,663 | 11/1935 | Stapleford | 229/17 R |
| 2,634,922 | 4/1953 | Taylor, Jr. | 242/163 |
| 2,974,850 | 3/1961 | Mayer | 206/409 |
| 3,178,130 | 4/1965 | Taylor, Jr. | 242/163 |
| 3,748,817 | 7/1973 | Newman | 242/163 |
| 3,982,712 | 9/1976 | Bassett . | |
| 4,019,636 | 4/1977 | Wise | 206/409 |
| 4,057,204 | 11/1977 | Zajac . | |
| 4,122,949 | 10/1978 | Blatt | 206/408 |
| 4,274,607 | 6/1981 | Priest | 242/163 |

FOREIGN PATENT DOCUMENTS

| | | | |
|---|---|---|---|
| 91456 | 7/1961 | Denmark | 242/163 |

*Primary Examiner*—William T. Dixson, Jr.
*Assistant Examiner*—Jimmy G. Foster
*Attorney, Agent, or Firm*—Richard W. Carpenter; Davis Chin

[57] ABSTRACT

A dispensing container for coiled strand material includes a hollow feed tube guide frictionally engaged with the underlying closure flap and interlockingly engaged with the die-cut closure flap of the container. A perforated knock-out portion is disposed on the outermost closure flap of the container for protecting the tube guide during shipment.

4 Claims, 6 Drawing Figures

DISPENSING CONTAINER

BACKGROUND OF THE INVENTION

1. Field Of The Invention

This invention relates generally to dispensing type packages and more particularly, to a dispensing container adapted to house a wound coil of a strand material such as wire, rope, tape and the like and for dispensing the same. The invention has particular application to non-reel packages of strand material having an open center which permits a free inner end of the strand material to be readily withdrawn from the interior of the coil at relatively high rates in the payout of the material. Typically, these packages are utilized as a shipping container as well as for a dispensing receptacle.

2. Description Of The Prior Art

The prior art appears to be best exemplified in the following patents which were developed in a search directed to the subject matter of this application:

U.S. Pat. Nos. 2,634,922; 2,974,850; 3,982,712; 4,019,636; and 4,057,204.

None of the prior art uncovered in the search disclosed a dispensing container like that of the present invention which provides a hollow feed tube guide frictionally engageable with the underlying closure flaps of the container and interlockingly engaged with the die-cut closure flap of the container. A perforated knock-out portion is provided on the outermost closure flap of the container for protecting the tube guide during shipment. A hinged flap having tearable perforation is provided on a major side wall of the container for viewing the amount of strand material remaining on a coil when the perforations are fully torn.

SUMMARY OF THE INVENTION

Accordingly, it is a general object of the present invention to provide an improved shipping and dispensing package for coiled strand material.

It is another object of the present invention to provide a dispensing container which is readily formable from a single sheet of suitable structural material and includes a hollow feed tube guide frictionally engageable with the underlying closure flaps and interlockingly engaged with the die-cut flap of the container.

It is another object of the present invention to provide a dispensing container which includes a perforated knock-out portion disposed on the outermost closure flap of the container for protecting a tube guide during shipment.

It is still another object of the present invention to provide a dispensing container which includes a hinged flap having tearable perforations disposed on a major side wall of the container for viewing the amount of strand material remaining on the coil when the perforations are fully torn.

BRIEF DESCRIPTION OF THE DRAWINGS

These and other objects and advantages of the present invention will become more fully apparent from the following detailed description when read in conjunction with the accompanying drawings wherein.

DESCRIPTION OF THE PREFERRED EMBODIMENT

Figure 1:
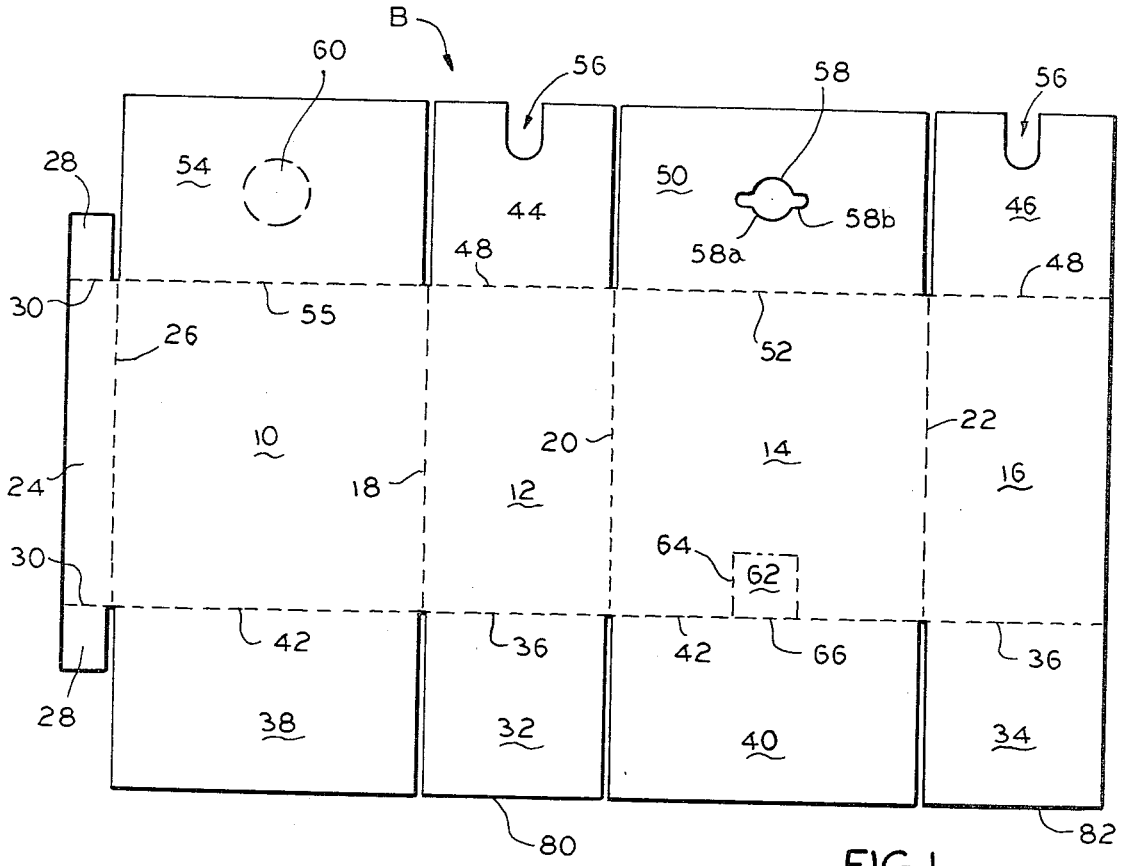
FIG. 1 is a plan view of a blank for forming the dispensing container in accordance with the present invention.
Figure 2:
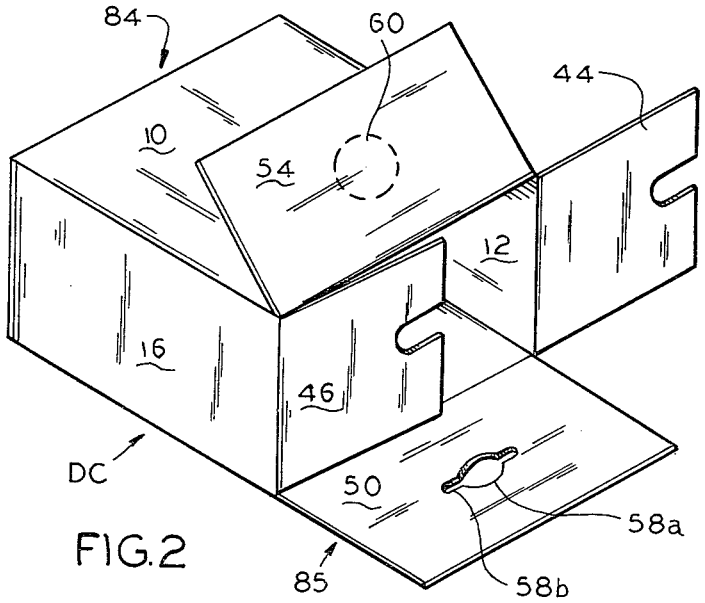
FIG. 2 is a perspective view of an assembled dispensing container of the present invention with the dispensing end closure flaps in the partially opened condition.
Figure 4:
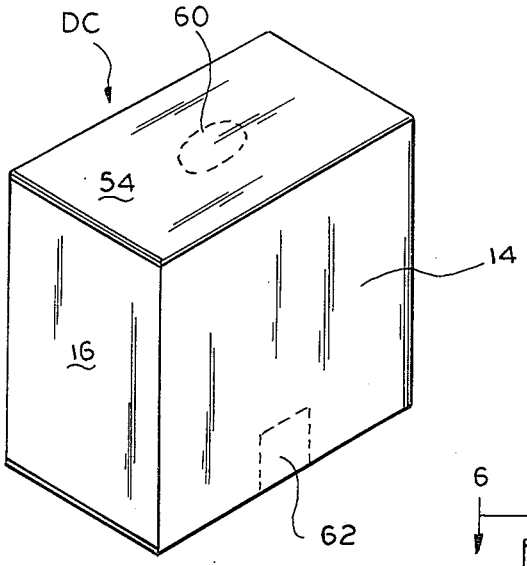
FIG. 4 is a perspective view of a fully assembled dispensing container of the present invention.

Referring now in detail to the various views of the drawings, there is shown in FIG. 1 a blank B of a single sheet of suitable structural material such as corrugated paperboard or the like used to form a dispensing container DC of FIGS. 2 and 4. The blank includes a first major side panel 10, a first minor side panel 12, a second major side panel 14, and a second minor side panel 16 which are hinged in side-to-side relation at fold lines 18, 20, and 22. A joint flap 24 is hinged at fold line 26 to the free end of the side panel 10 and is adapted for bonding in a suitable manner to the inside surface of the side panel 16 near its free end when forming the assembled dispensing container DC. A pair of glue flaps 28 are joined at fold lines 30 to the opposed ends of the joint flap 24.

Inner closure flaps 32, 34 are hinged to one edge of the minor side flaps 12, 16 at fold lines 36. Outer closure flaps 38, 40 are hinged to one edge of the major side panels 10, 14 at fold lines 42. At the other end of the container defined to be the dispensing end, underlying closure flaps 44, 46 are connected to the other edge of the minor side panels 12, 16 at fold lines 48. A die-cut closure flap 50 is connected to the other edge of the major side panel 14 at fold line 52. An outermost protective closure flap 54 is connected to the outer edge of the major side panel 10 at fold line 55.

Each of the underlying closure flap 44, 46 is provided with an arcuate cut-out 56. The flap 50 has a die-cut portion 58 consisting of a circular portion **58*a* and notches 58*b*. The flap 54 has a circular perforated area 60 formed therein. The second major side panel 14 has a flap 62 disposed adjacent the outer closure flap 40. The flap 62 is defined by perforation 64 and by a hinge portion 66 which permits the flap to pivot between a closed position and an open position when the perforations are fully torn. The function and purpose of the arcuate cut-out 56, die-cut portion 58, perforated area 60 and flap 62** will all be discussed more fully hereinafter.

Figure 3:
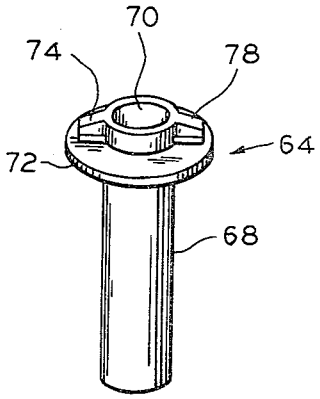
FIG. 3 is a perspective view of the tube guide forming an element of the present invention.
Figure 5:
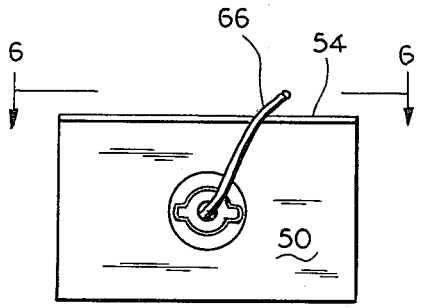
FIG. 5 is an end view of the dispensing container with the strand of material in its initial stage of dispensing.

In accordance with the invention, a hollow feed tube guide 63 shown in FIG. 3 is adapted to be received within a coil (not shown) wound in any suitable manner that will result in a coil which has an open center and is capable of having a wire 65 (FIG. 5) payed out from the interior of the coil. For example, a coil of flexible material wound in such a manner is shown in U.S. Pat. No. 3,178,130 to Taylor wherein a coil is wound in a plurality of figure-8s for inner end feed out. To this end, the tube guide 63 has an inner end 68 insertable radial into the windings of the coil and has a bore 70 extending the entire length thereof to provide a passage to the open center of the coil through which the free end of the wire 65 is received and guided as it is being unwound from the dispensing container DC.

The tube guide 63 includes an annular flange 72 which extends radially from the outer surface thereof and a pair of projections 74 spaced apart from the flange 72 is provided. Projection 74 having inclined surfaces 78 are sloped toward the flange 72. The space between the projections 74 and the flange 72 define an area which has a dimension related to the thickness of the die-cut closure flap 50 so that it can be received tightly therein.

The dispensing container is assembled by folding the blank B into the form depicted in FIG. 2. Thus, the side panels 10, 12, 14, 16 are folded along fold lines 18, 20, 22, 26 to form a tubular structure utlizing the joint flap 24 and the glue flaps 28 to secure the structure. The glue flaps 28 are adapted for bonding in a suitable manner to the inside surfaces of the closure flaps 34 and 46, respectively. Next, the inner closure flaps 32, 34 are folded inwardly so that edges 80, 82 are in face-to-face relationship. The closure flap 40 is folded upwardly and the closure flap 38 is folded downwardly to form end 84 of the dispensing container. The closure flaps 38 and 40 are sealed together in any appropriate manner. The not-shown coil is placed into the structure thus far formed via the dispensing end 85 so that the open ends of the coil engage the inside surfaces of the minor side panels 12, 16. The free end of the wire 65 is passed through the die-cut portion 58 in the flap 50 and is then fed through at the inner end 68 of the tube guide 63 to the bore 70 and out the outer end thereof.

Figure 6:
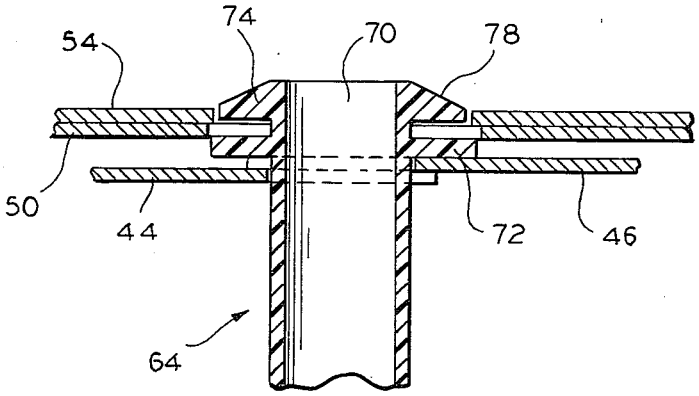
FIG. 6 is a cross-sectional view along the lines 6—6 of FIG. 5 with the outermost closure flap in the closed position.

The underlying closure flaps 44, 46 are folded inwardly into overlapping relation to provide an aperture defined by the overlapping arcuate cut-outs 56. The inner end 68 of the tube guide 63 is inserted through the aperture and into the body of the coil. The flap 50 is folded upwardly and the tube guide 63 is rotated so that the projections 74 will mate with the notches 58*b* of the die-cut portion. In this condition shown in FIG. 5, the flaps 44, 46 overlap each other so that the arcuate cut-out 56 engages snugly the outer surface of the tube guide 63. The tube guide is then rotated 90 degrees for interlockingly engagement with the flap 50. Finally, the outermost closure flap 54 is folded downwardly so that the perforated area 60 contacts the end of the tube guide 63 for protection during shipment as illustrated in FIG. 6. The flaps 50, 54 are bonded together in any suitable manner.

When the container is ready for dispensing, the area 60 is initially knocked-out from the flap 54 to provide an aperture through which the free end of the wire 65 can be withdrawn from the container in the desired amount. The flap 62 is torn at perforations 64 and is folded to the open position to accommodate viewing the amount of strand material remaining on the coil.

While there has been illustrated and described what is at present to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention, but that the invention will include all embodiments falling within the scope of the appended claims.

What is claimed is:

1. A dispensing container for coiled strand material comprising in combination:
   - a pair of opposed major side walls and a pair of opposed minor side walls;
   - end closure flaps connected to end edges at one end of each said major and minor side walls and foldable to form an end of the container;
   - a pair of underlying closure flaps connected to other end edges of said minor side flaps, each of said underlying closure flaps having an arcuate cut-out and adapted to be folded inwardly in overlapping relation with each other to provide an aperture;
   - a die-cut closure flap connected to the outer end edge of one of said major side walls;
   - a coil of strand material wound in a plurality of figure-8s for payout from the interior of the coil;
   - a hollow feed tube guide extending radially through the body of the coil and having a bore through which the free end of the strand material is passed as it is being unwound, said tube guide having an annular flange and a pair of projections spaced from said flange;
   - said underlying flaps frictionally engaging the outer surface of the tube guide, said die-cut flap being interlockingly engaged between the flange and projections of said tube guide; and
   - an outermost closure flap conneted to the other end edge of the other major side wall, said outermost flap having a circular perforated area for engaging the outer end of the tube guide for protecting it during shipment.

2. A dispensing container as claimed in claim 1, wherein one of the major side walls includes a hinged flap having tearable perforations for viewing the amount of strand material remaining on the coil when the perforations are fully torn.

3. A container blank for dispensing coiled strand material comprising:
   - a first major side panel, a first minor side panel, a second major side panel, and a second minor side panel all connected in side-by-side relation;
   - closure flaps connected to lower edges of said major and minor side panels;
   - an underlying closure flap having an arcuate cut-out connected to upper edges of said first and second minor side panels;
   - a die-cut closure flap having a cut-out adapted to interlockingly engage a hollow tube guide and being connected to an upper edge of one of said major side panels; and
   - an outermost flap having a circular perforated area and being connected to an upper edge of the other said one of said major side panels.

4. A container blank as claimed in claim 3, wherein a joint flap having a pair of glue flaps is hinged to the free side edge of one of said side wall panels.

* * * * *